US008214954B2

(12) United States Patent
Ashrafzadeh et al.

(10) Patent No.: US 8,214,954 B2
(45) **Date of Patent: *Jul. 10, 2012**

(54) ADAPTIVE WATER LEVEL ADJUSTMENT FOR AN AUTOMATIC WASHER

(75) Inventors: Farhad Ashrafzadeh, Stevensville, MI (US); Kalyanakrishnan Vadakkeveedu, College Station, TX (US); Raveendran Vaidhyanathan, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/093,291

(22) Filed: Apr. 25, 2011

(65) Prior Publication Data

US 2011/0191964 A1 Aug. 11, 2011

Related U.S. Application Data

(63) Continuation of application No. 11/605,981, filed on Nov. 29, 2006, now Pat. No. 7,950,086.

(51) Int. Cl.
*D06F 35/00* (2006.01)
*D06F 39/00* (2006.01)

(52) U.S. Cl. ..... 8/158; 8/159; 68/12.01; 68/12.02; 68/12.04

(58) Field of Classification Search ..... None
See application file for complete search history.

(56) References Cited

U.S. PATENT DOCUMENTS 6,151,742 A * 11/2000 Dausch et al. ..... 8/158

* cited by examiner

*Primary Examiner* — Michael Barr
*Assistant Examiner* — Jason Ko
(74) *Attorney, Agent, or Firm* — Clifton G. Green; McGarry Bair PC

(57) ABSTRACT

An apparatus and method for determining the degree of engagement between a clothes mover and fabric items during a wash process, and a method for setting the liquid level in the automatic washer based on the degree of engagement between a clothes mover and the fabric items.

12 Claims, 7 Drawing Sheets

ADAPTIVE WATER LEVEL ADJUSTMENT FOR AN AUTOMATIC WASHER

CROSS-REFERENCE TO RELATED APPLICATIONS

The present application represents a continuation of U.S. patent application Ser. No. 11/605,981 entitled "Adaptive Water Level Adjustment for an Automatic Washer" filed Nov. 29, 2006, pending.

BACKGROUND OF THE INVENTION

1. Field of the Invention

The invention relates to a method for setting a liquid level in an automatic clothes washer.

2. Description of the Related Art

Automatic clothes washers are ubiquitous. Such appliances clean fabric items effectively, enabling the homeowner to complete other tasks or engage in more satisfying activities while doing the laundry. Modern clothes washers provide a multitude of options for matching a selected cleaning operation to the type of fabric comprising the laundry load and the degree of soiling of the laundry load. This includes setting a liquid level appropriate to the size and fabric type of the laundry load. Modern clothes washers also include sophisticated controllers that are programmed to maximize cleaning efficiency while minimizing water and power consumption. However, despite the capabilities of the modern clothes washer, the appliance remains limited in its ability to set the liquid level based on real-time information relating to the fabric items being laundered.

One type of conventional automatic clothes washer is provided with a drive motor, generally electrically powered, which is used to drive a cylindrical perforate basket during a spin cycle, and a clothes mover during wash and rinse cycles for agitating the laundry load within the basket.

In a conventional automatic clothes washer, cleaning of the fabric items is primarily attributable to three factors: chemical energy, thermal energy, and mechanical energy. These three factors can be varied within the limits of a particular automatic clothes washer to obtain the desired degree of cleaning.

The chemical energy is related to the types of wash aids, e.g. detergent and bleach, applied to the fabric items. All other things being equal, the more wash aid that is used, the greater will be the cleaning effect.

The thermal energy relates to the temperature of the fabric items. The temperature of the wash liquid typically is the source of the thermal energy. However, other heating sources can be used. For example, it is known to use steam to heat the fabric items. All things being equal, the greater the thermal energy, the greater will be the cleaning effect.

The mechanical energy is attributable to the contact between the clothes mover and the fabric items, the contact between the fabric items themselves, and the passing of the washing liquid through the fabric items. In washing machines with a clothes mover, in addition to the clothes mover contacting the fabric items, the clothes mover tends to cause the fabric items to contact themselves, and for the wash liquid to pass through the fabric items. All things being equal, the greater the amount of mechanical energy, the greater will be the cleaning effect.

These three factors can be adjusted to obtain the desired cleaning effect for the anticipated operating conditions and environment. For example, while the direct contact between the clothes mover and the fabric items is beneficial for laundering, it does cause greater physical wearing of the fabric items than the other two factors. Thus, for example, for more delicate clothing, it is desired to reduce the degree of contact. The liquid level in the basket affects all three factors (i.e. chemical energy, thermal energy, and mechanical energy) in the following way: A lower liquid level than required results in more contact between fabric items and the clothes mover and consequently more fabric damage. It also requires less thermal energy to reach to a preselected temperature. Furthermore, for a given amount of detergent, it leads to a more concentrated chemical wash. Conversely, more liquid results in less mechanical energy, more thermal energy, and a less concentrated wash. As a result, in both cases, the performance of the washer will be less than optimal based on the desired combination of the various energies.

Currently, the liquid level is adjusted based on amount of load (either by user or automatically) and even with contemporary washing machines, it has not yet been possible to determine the degree of contact between the fabric mover and the fabric items during the washing process. Thus, contemporary solutions are estimates or empirical data, both of which are typically determined based on a set of standard test conditions. Unfortunately, these standard test conditions are not guaranteed to be repeated when the clothes washer is used by the consumer, resulting in a compromised cleaning result.

SUMMARY OF THE INVENTION

An apparatus and method for determining the degree of engagement between a clothes mover and fabric items during a wash process, and a method for setting the liquid level in the automatic washer based on the degree of engagement between a clothes mover and the fabric items.

DESCRIPTION OF AN EMBODIMENT OF THE INVENTION

The invention includes the real-time determining of the degree of engagement between a clothes mover and one or more fabric items during a clothes washing cycle. The invention further includes a method of setting a liquid level in a clothes washer based upon the mechanical energy imparted to the fabric items by the engagement of a clothes mover with fabric items in a laundry load, which equates to a normal force exerted on the clothes mover by the total weight of the fabric items. The method utilizes operational characteristics of a drive motor, such as angular velocity or current, to determine the degree of engagement of the clothes mover with the laundry load as a function of liquid level. The engagement of the clothes mover with the laundry load is compared with predetermined threshold for the degree of engagement to control the introduction of liquid to set the desired liquid level.

Conventional automatic clothes washers enable a user to select one of several laundering options based upon the type of laundry load being placed in the clothes washer. For example, selectable options can include "normal," "delicates," "woolens," and the like. These are typically referred to as "cycles." As utilized herein, "laundering cycle" will refer to a specific cycle, such as "normal," extending from the beginning of the cycle to its completion. A laundering cycle will generally consist of at least a wash cycle, a rinse cycle, and a spin cycle. The wash cycle, the rinse cycle, and the spin cycle may consist of several steps, such as a fill step, a drain step, a pause step, an agitation step, and the like. The invention can be used with any laundering cycle regardless of the types and combination of steps.

Figure 1:
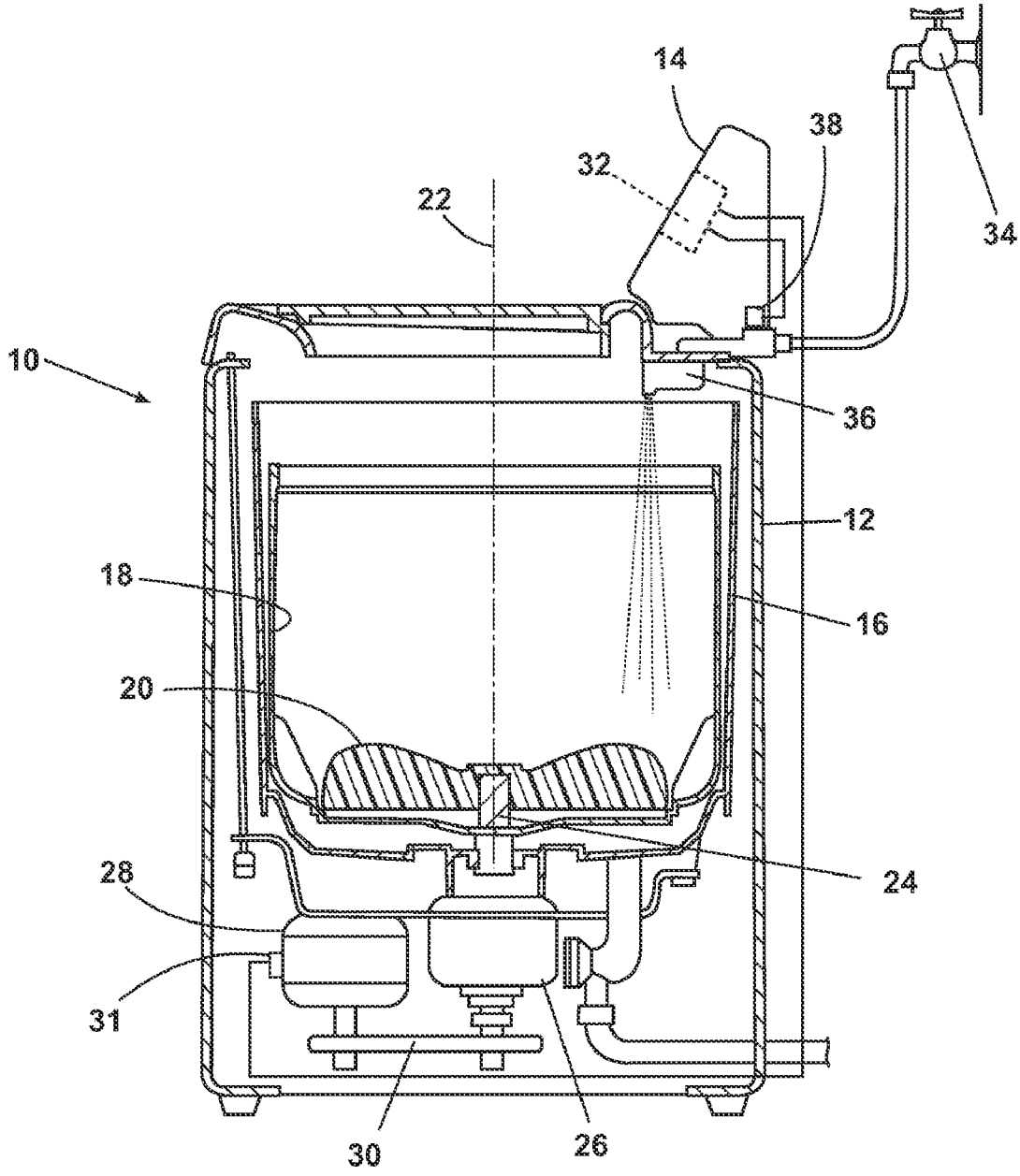
FIG. 1 is a partially cut away elevational view of an automatic clothes washer according to the invention illustrating relevant internal components thereof, including a clothes basket, and a clothes mover.

FIG. 1 illustrates an embodiment of the invention consisting of a vertical axis automatic clothes washer 10 comprising a cabinet 12 having a control panel 14, and enclosing a liquid-tight tub 16 defining a wash chamber in which is located a perforate basket 18. Thus, fabric items placed in the basket 18 are placed in the wash chamber. A clothes mover 20 adapted for imparting movement to a laundry load contained within the basket 18 can be disposed in the bottom of the basket 18. The clothes mover 20 is illustrated as a low profile vertical axis impeller. However, the clothes mover 20 can also be a vertical axis agitator, with or without an auger, or a basket adapted with peripheral vanes. The clothes mover 20 and basket 18 can be coaxially aligned with respect to a vertically oriented oscillation axis 22.

While the invention will be illustrated with respect to a low profile impeller, other clothes movers can be utilized without departing from the scope of the invention. For example, it is contemplated that the invention has applicability to horizontal axis washers as well as to the vertical axis washers. For purposes of this application, horizontal axis washer refers to those types of washers that move the fabric items primarily by lifting the fabric items and letting them fall by gravity, regardless of whether the axis of rotation is primarily horizontal, and vertical axis washer refers to those types of washers that move fabric items by a clothes mover, regardless of whether the axis of rotation is primarily vertical.

The clothes mover 20 can be operably connected to a drive motor 28 through an optional transmission 26 and drive belt 30. One or more well-known sensors 31 for monitoring motor speed, current, voltage, and the like, can be operably connected to the motor 28. Outputs from the sensors 31 can be delivered to a machine controller 32 in the control panel 14. In many applications, the sensors 31 form part of a motor controller coupled to the machine controller 32. The machine controller 32 can be adapted to send and receive signals for controlling the operation of the clothes washer 10, receiving data from the sensors 31, processing the data, displaying information of interest to a user, and the like.

The type and configuration of motor controller, sensors, 31, and machine controller 32 is not germane to the invention. Any suitable control system can be used that outputs the motor data, such as speed and current, as described in greater detail below.

The clothes washer 10 can also be connected to a source of water 34 which can be delivered to the tub 16 through a nozzle 36 controlled by a valve 38 operably connected to the machine controller 32. The valve 38 and the machine controller 32 can enable a precise volume of water to be delivered to the tub 16 for washing and rinsing.

Figure 2:
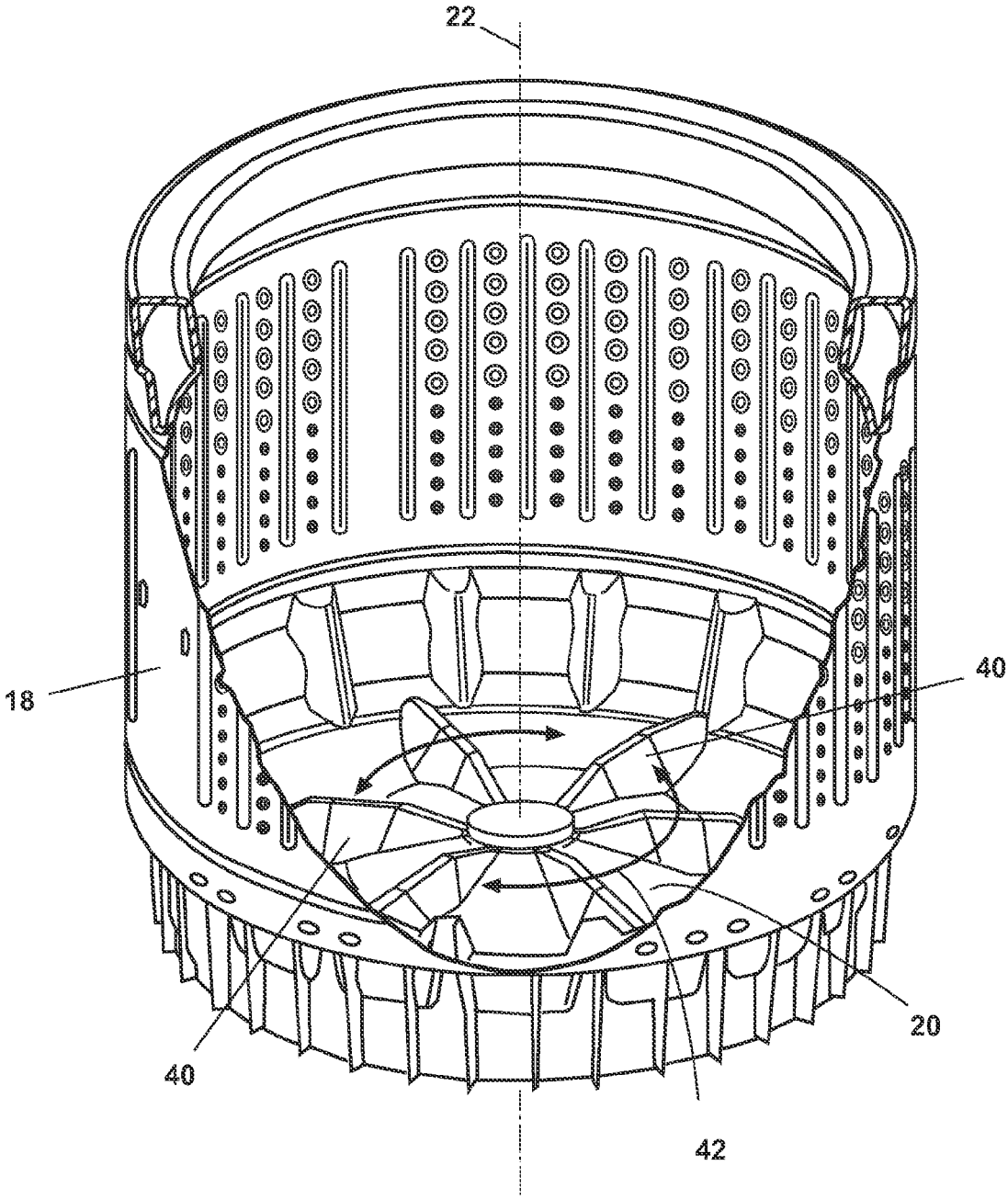
FIG. 2 is a partially cut away perspective view of the clothes basket and clothes mover illustrated in FIG. 1.

FIG. 2 illustrates the clothes basket 18 and the clothes mover 20 in coaxial alignment with the oscillation axis 22. The clothes mover 20 can be a somewhat circular, platelike body having a plurality of radially disposed vanes 40 extending upwardly therefrom. The vanes 40 can be adapted to contact and interact with fabric items and liquid in the basket 18 for agitating the fabric items and the liquid. During a wash cycle and a rinse cycle, the clothes mover 20 can be driven by the drive motor 28 for movement within the wash chamber. The basket 18 can be braked to remain stationary during the movement of the clothes mover 20, or the basket 18 can freely rotate during the movement of the clothes mover 20.

The drive motor 28 can drive the clothes mover 20 in an oscillating manner, first in a forward direction, referred to herein as a forward stroke, then in a backward direction, referred to herein as a backward stroke. The clothes mover 20 can move in a forward direction through a preselected angular displacement, for example, ranging from 180° to 720°. The clothes mover 20 can move in a backward direction through a similar preselected angular displacement. A complete forward stroke and backward stroke is referred to herein as an oscillation cycle.

In a typical wash cycle, multiple fabric items, which collectively form a laundry load, are placed in the basket on top of the clothes mover 20. Some of the fabric items will be in direct contact with the clothes mover 20 and some will not. As the clothes mover 20 moves, the individual fabric items will be moved directly or indirectly by the clothes mover 20 to impart mechanical energy to the items, which will move the fabric items about the interior of the wash chamber.

Figure 3:
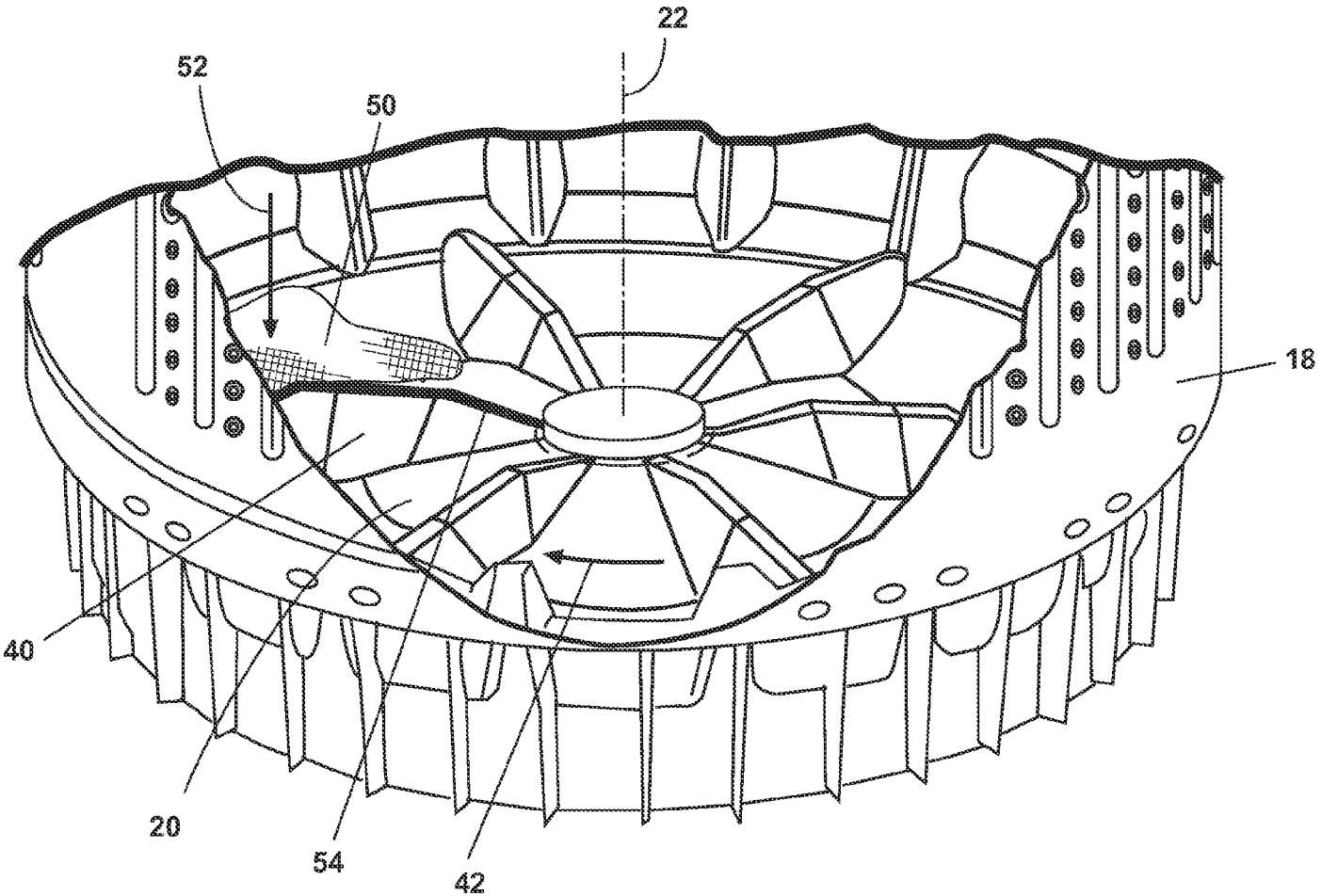
FIG. 3 is a partially cut away enlarged view of the clothes basket and clothes mover illustrated in FIG. 2 showing an article of clothing in a first configuration relative to the clothes mover.
Figure 4:
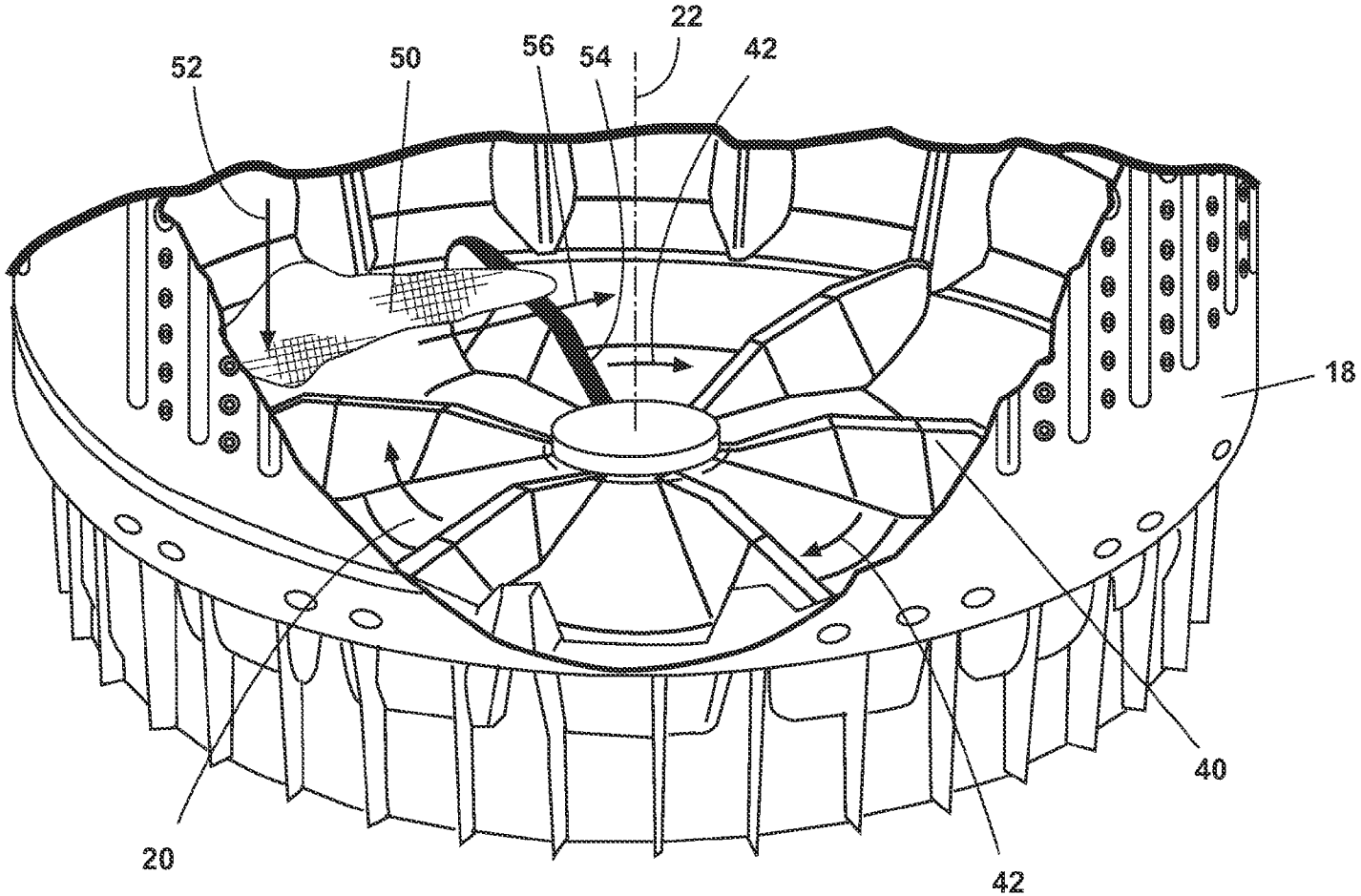
FIG. 4 is a view of the clothes basket and clothes mover illustrated in FIG. 3 showing the article of clothing in a second configuration relative to the clothes mover.
Figure 5:
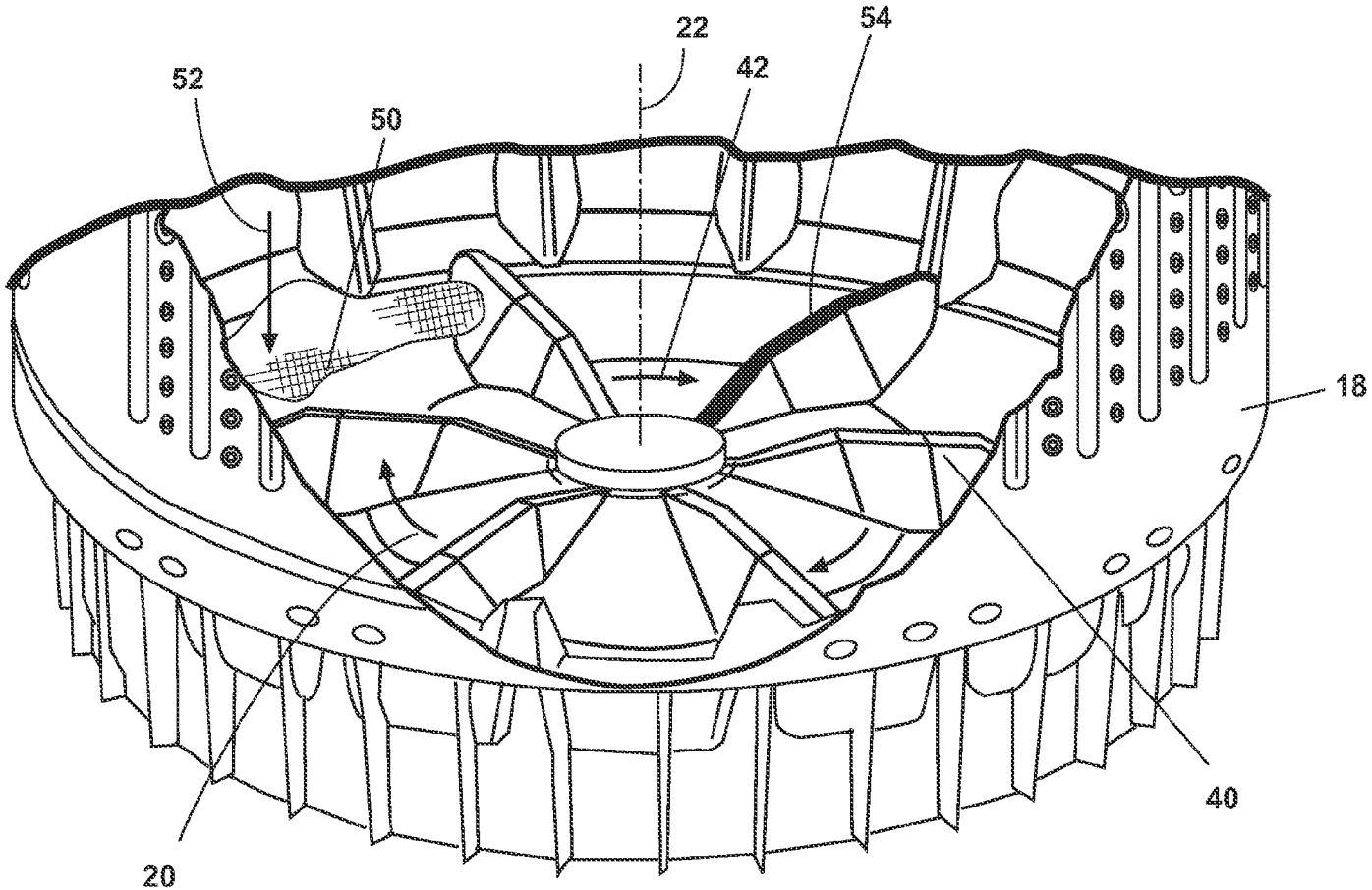
FIG. 5 is a view of the clothes basket and clothes mover illustrated in FIG. 3 showing the article of clothing in a third configuration relative to the clothes mover.

FIGS. 3-5, illustrate the movement of a single fabric item 50 that is in contact with the clothes mover 20. No liquid is illustrated for clarity in FIGS. 3-5. However, it should be understood that liquid is present and it can be at any level from just wetting the fabric items to fully submerging the fabric items.

As illustrated in FIG. 3, the fabric item 50 in a lower portion of a laundry load will be in contact with the clothes mover 20. The fabric item 50 can be represented by a downwardly directed weight factor 52. The vanes 40 terminate in an upper vane edge 54. All or part of the vane 40 can contact the fabric item 50 during the forward and backward strokes of the clothes mover 20. As the clothes mover 20 is rotated in a forward stroke, represented by the motion vector 42, a vane 40 can be brought into contact with the fabric item 50.

Referring now to FIG. 4, the contacting of the vane 40 with the fabric item 50 tends to move the fabric item 50 in the direction of rotation of the clothes mover 20, represented by the pull vector 56. Because of the weight of the fabric item 50, the weight of overlying fabric items, the frictional relationship between the fabric item 50 and the vane edge 54, the degree of wetting of the fabric item 50, and other factors, there can be intermittent contacting and slipping by the vane 40 relative to the fabric item 50 which will be reflected in movement of the fabric item 50 that may not be the same rotational distance as the clothes mover 20, resulting in relative movement between the fabric item 50 and the clothes mover 20. As illustrated in FIG. 5, if there is sufficient slippage, at some point during the forward stroke the vane 40 can separate from the fabric item 50.

The intermittent contacting and slipping of the vane 40 with respect to the clothes mover 20 results in an intermittent engagement of the fabric item with the clothes mover 20 by the application of the weight of the fabric item 50 to the clothes mover 20, which amounts to a loading and unloading of the clothes mover 20. The engagement and disengagement associated with the loading and unloading present as a change in speed of the clothes mover 20, which is sensed by the sensors 31. In response, the controller 32, which typically tries to move the motor 28 at a predetermined set speed for the given cycle, will increase or decrease the current to the motor 28 to attempt to maintain the set speed.

The magnitude and frequency of engagement is impacted by several factors, only some of which will now be described. If the load comprises multiple fabric items, their total weight will impact the clothes mover. Thus, all else being equal, the greater the size of the laundry load, the greater will be the loading of the clothes mover by the fabric items. The increased volume of the greater laundry load will also tend to inhibit the free movement of the fabric items within the wash chamber, which will tend to keep the fabric items in contact with the clothes mover 20 as there is less space for the fabric items to move and their individual free movement is inhibited by surrounding fabric items.

Wet fabric items tend to create greater frictional resistance with the clothes mover than dry fabric items. However, as liquid level increases in the wash chamber to the point where the fabric items are fully submerged, the additional liquid brings into effect the buoyancy of the fabric items, which has an opposite effect than the weight force of the fabric items. In some instances, the liquid may be sufficiently deep and the clothes mover may sufficiently agitate the liquid that some or all of the fabric items are suspended in the liquid above the clothes mover 20, which will greatly reduce the loading of the clothes mover 20 by the fabric items. Thus, all things being equal, the deeper the liquid, the more the degree of loading and unloading will be minimized.

Looking at particular scenarios, if the clothes washer 10 contains only liquid, i.e. no fabric items, the loading/unloading of the clothes mover 20 is minimal to nonexistent during the oscillation cycle because the clothes mover 20 is, for the most part, in contact with the same amount of liquid throughout each stroke, which essentially places a generally constant load on the clothes mover 20.

Figure 6:
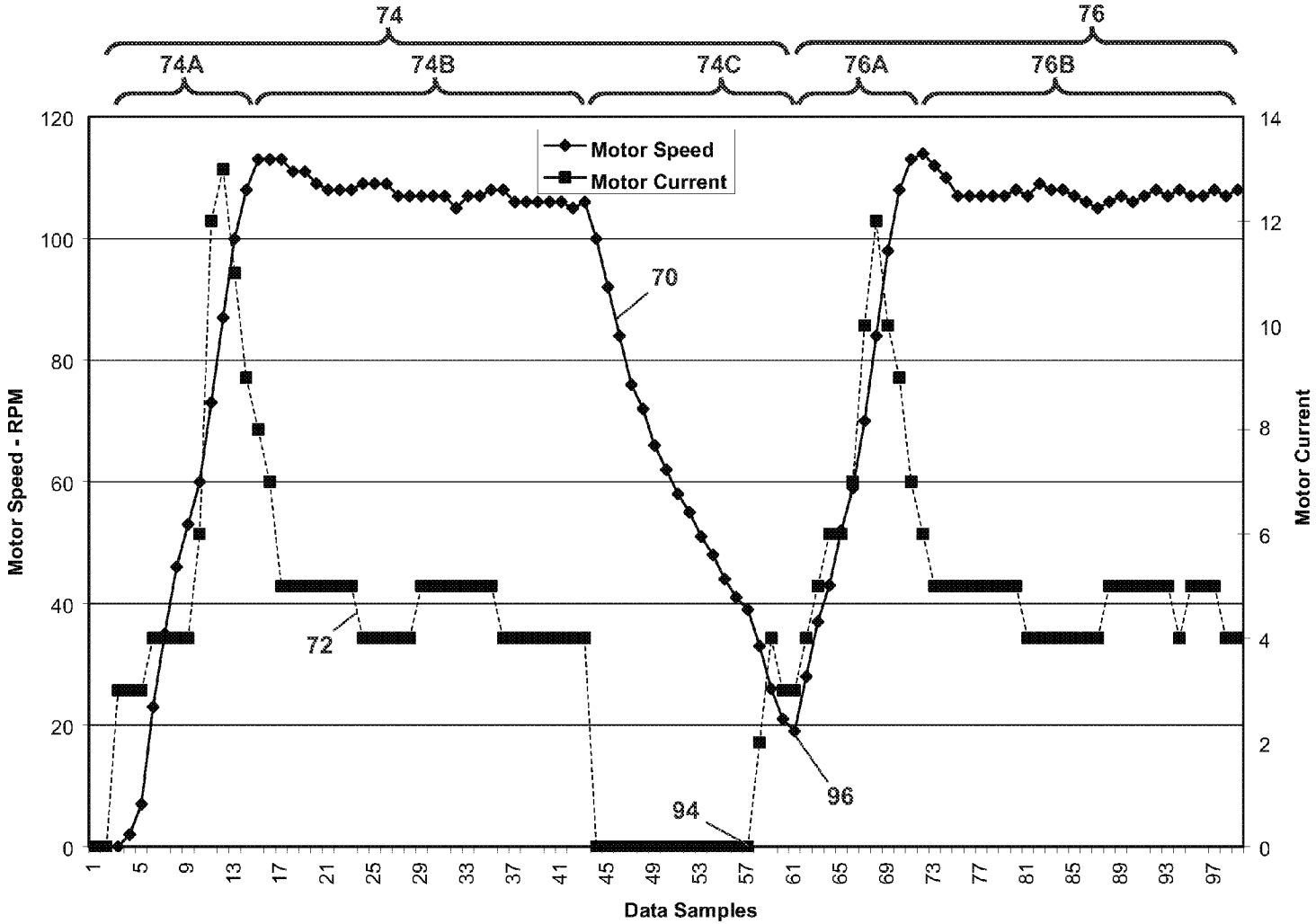
FIG. 6 is a first graphical representation of motor speed and motor current for the automatic clothes washer illustrated in FIG. 1 containing only liquid during a single cycle of the clothes mover consisting of a forward rotational stroke followed by a backward rotational stroke.

FIG. 6 graphically illustrates a waveform of the motor speed 70 and the motor current 72 when the basket 18 contains only liquid and no fabric items. It also illustrates one oscillation cycle of the clothes mover 20 through a forward stroke, represented by a forward direction region 74, followed by movement in a backward stroke, represented by a backward direction region 76. The waveforms of FIG. 6 are generated by sampling the motor speed 70 and motor current 72 at a predetermined time interval or sampling rate, which in this case is 20 milliseconds.

As illustrated in FIG. 6, in the forward direction region 74 the movement of the clothes mover during the forward stroke can be divided into an acceleration step 74A, where the clothes mover 20 is quickly accelerated to a predetermined set speed, a maintain speed step 74B, where the motor speed is maintained at the predetermined set speed, and a deceleration step 74C, where the clothes mover is quickly decelerated for reversal, which can include braking, prior to reversing. Step 74B is often referred to as the plateau.

The backward direction region 76 is similarly divided into an acceleration step 76A, a plateau 76B, and a deceleration step 76C. Thus, when the clothes mover 20 transitions from the forward stroke to the backward stroke, the motor current 72 decreases to a zero value 94, and the motor speed 70 responsively decreases to a zero or nearly zero value 96. While the decrease in speed is not shown going to zero in FIG. 6, this is a result of the sampling rate for the data points—the zero speed was not sampled—not an indication that the speed does not go to zero. In reality, whenever the clothes mover 20 changes direction, there is necessarily a point, which might be instantaneous, where the speed is zero.

During the forward and backward strokes as illustrated in FIG. 6, the controller controls the speed of the motor during the plateau 74B, 76B in an attempt to maintain the motor speed at a predetermined set point speed, which for the example in FIG. 6 is 110 RPM. Thus, the speed of the clothes mover 20 is essentially constant at approximately the 110 RPM set speed in the plateau 74B, 76B of the curve 70. There are nominal variations or ripples in the magnitude of the motor current and motor speed in the plateaus 74B, 76B due to the nominal loading and unloading of the liquid on the clothes mover 20 associated with the engagement of the clothes mover 20 with the liquid as the clothes mover 20 moves through the liquid. This loading and unloading is transmitted through the clothes mover 20 and the transmission 26 to the drive motor 28 where it is sensed by the speed sensor 31. The loading and unloading causes nominal, temporary changes in the speed of the clothes mover 20 relative to the set speed. In response, the controller 32 adjusts the current to the motor 28 in an attempt to maintain the set speed, which results in the motor current leading the speed as is easily seen in FIG. 6.

Figure 7:
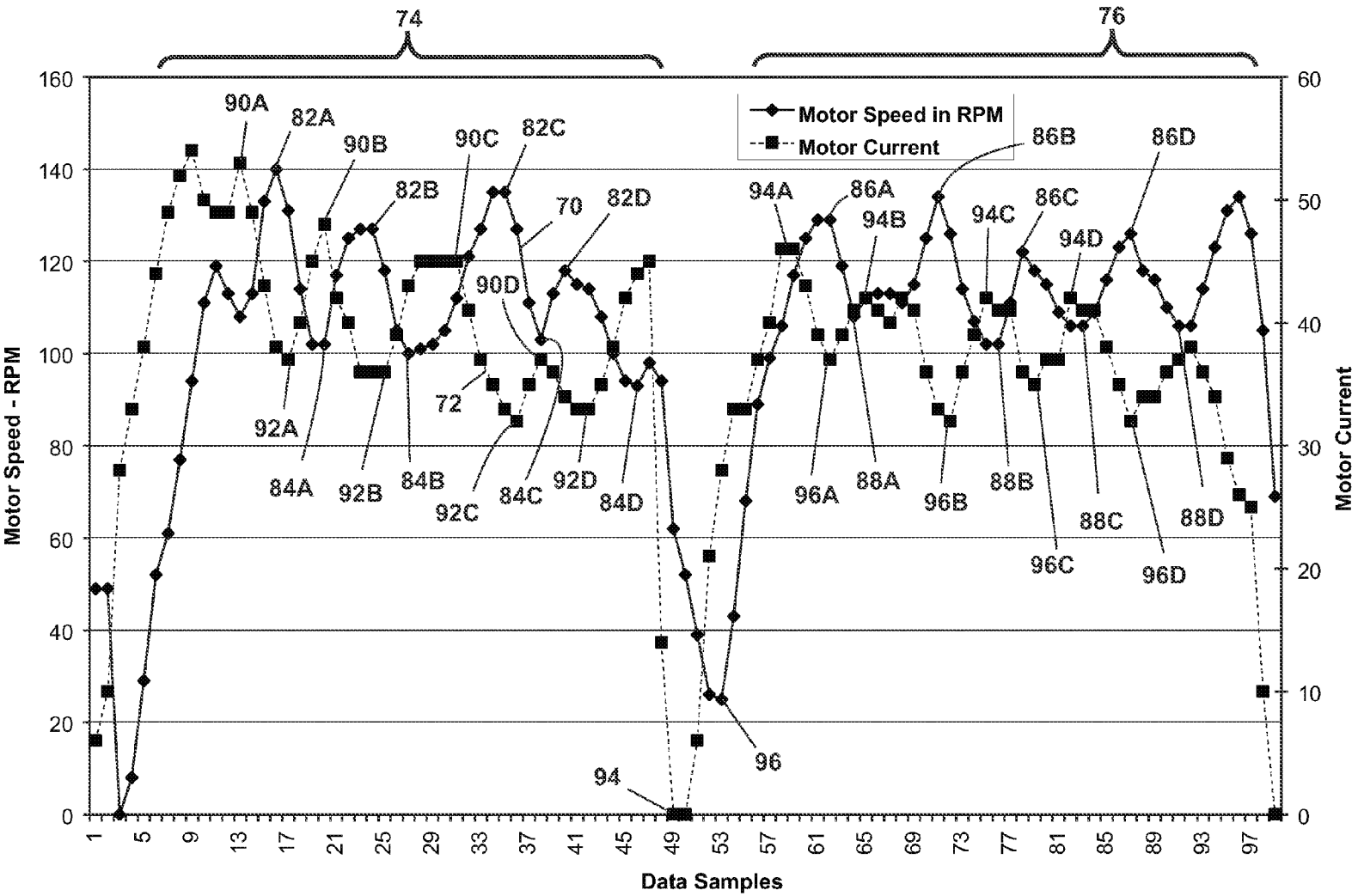
FIG. 7 is a second graphical representation of motor speed and motor current for the automatic clothes washer illustrated in FIG. 1 containing liquid and a laundry load during a single cycle of the clothes mover consisting of a forward rotational stroke followed by a backward rotational stroke.

FIG. 7 graphically illustrates the waveforms for the motor current 72 and motor speed 70 signals attributable to the loading and unloading of the clothes mover 20 when there is a load of fabric items 50 in the wash chamber for one oscillation cycle of the clothes mover 20. FIG. 7 illustrates the waveforms of the motor speed 70 and motor current 72 where the motor speed set point is 120 RPM and the sampling rate is 20 milliseconds. The intermittent loading/unloading of the fabric items 50 with the vanes of the clothes mover 20 is also transmitted through the clothes mover 20 and the transmission 26 to the drive motor 28, where it is manifested as ripples in the waveform during the plateaus 74B, 76B for the motor speed 70 and motor current 72. These ripples define a waveform having multiple peaks. The magnitude of the peaks is much greater than the ripples in FIG. 6 because of the greater force exerted by the fabric items to the clothes mover as compared to the liquid alone.

Looking more closely at the ripples of the motor speed waveform, the ripples can be separated into peaks comprising positive peaks 82*a-d*, 86*a-d* and negative peaks 84*a-d*, 88*a-d*. The amplitude or magnitude of the ripples can be determined by comparing the peaks to the motor speed set point. For example, the difference between the positive speed amplitude 82*a-d* and the target rotation speed can be a first amplitude value. Similarly, the difference between the negative speed amplitude 84*a-d* and the target rotation speed, preferably expressed as an absolute value, can be a second amplitude value. Alternatively, the area of the ripple (or total current) can be used as an indication of load. The motor speed 70 has a quasi-sinusoidal waveform for which a frequency can be determined using the peaks for the time of the plateau 74B, 76B.

The motor-current waveform 72 is similar to that of the motor speed in that the ripples can be separated into peaks comprising positive peaks 90*a-d*, 94*a-d* and negative peaks 92*a-d*, 96*a-d*. The number of peaks in the current waveform can also be used to calculate the frequency of the waveform.

As is shown in FIG. 7, the motor current waveform is generally similar to the motor speed waveform and the current tends to lead the speed in time. The patterns in the motor current waveform cause the corresponding patterns in the motor current waveform. The leading of the current relative to the motor speed is a result of the controller attempting to maintain the motor speed at a set speed, also referred to as the reference speed or the target speed. Because the magnitude of the current is determined by the controller as necessary to maintain the set speed, the motor current does not have a corresponding set point in the way that the motor speed has a set point. However, the current does tend to have a "steady-state" value for a given fabric load, liquid level, and motor speed.

These amplitude values for either or both of the motor speed and motor current can be stored by the machine controller 32 as individual data values as well as a cumulative value. Preferably, the amplitude values can be averaged and, more preferably, a running average of the amplitude values can be determined and stored by the machine controller 32.

While the waveforms containing data for the motor speed and the motor current have been available to those skilled in the art for a long time, the Inventors have determined that the motor speed data and motor current data can be used to determine the degree of engagement between the fabric items and the clothes mover. Additionally, this degree of engagement between the fabric items and the clothes mover is determined from the motor speed data and motor current data in real-time. In this sense, the use of the data amounts to a real-time sensor placed in the wash chamber for determining the degree of engagement. The degree of engagement increases with decreased liquid level. Thus, the use of the motor speed/current data can be thought of as a "virtual" liquid-level sensor. Such a sensor has never before been available.

The ability to determine or sense the degree of engagement is very beneficial to improving the laundering performance. The interaction of the vanes 40 with the laundry load results in mechanical action or work being delivered to the laundry load, which can both contribute a laundering effect to the load and cause abrasion, fracture, and wear of the fabric items. Some mechanical action is needed to obtain the desired amount of laundering. Mechanical action beyond that needed to launder the fabric items is not needed and not desired as it wears the fabric items without additional laundering benefit. Also, for some fabric items, especially delicate fabric items, it is desirable to keep the mechanical action below a predetermined magnitude. Therefore, it is important to control the degree of engagement between the fabric items and the clothes mover.

Once one has the ability to determine the liquid level, it is then possible to manipulate the wash cycle accordingly to select an optimal liquid level for a wash cycle, thereby reducing the volume of liquid consumed. The clothes washer also consequently requires less energy in filling and draining the wash tub. An adaptive liquid level indicator also facilitates control of the degree of engagement by controlling the liquid level in the clothes washer. All things being equal, the greater the liquid in the wash chamber, the less will be the degree of engagement or mechanical action between the clothes mover and the fabric items. Thus, the determined degree of engagement can be used to adjust the liquid level and thereby control the degree of engagement.

The relationship between the motor speed and motor current and the degree of engagement will be considered in greater detail. The amplitude of the motor speed or current peaks can provide an accurate estimate of the degree of engagement of the clothes mover 20 with the laundry load, thereby enabling the liquid level to be set, since as discussed above, the degree of engagement will decrease as the liquid level increases. The degree of engagement of a clothes mover with fabric items in a laundry load can be given by the following relationship:

$$\text{Engagement} = \text{cl} * \text{Peak Amplitude}$$

where

Engagement=engagement of clothes mover 20 with fabric items,

Peak Amplitude=amplitude of peaks in motor speed or motor current, and cl=constant based on shape of clothes mover 20.

Engagement is a function of the magnitude of contact between the clothes mover 20 and the fabric items. The amplitudes of the ripples correlate with the degree of engagement of the fabric items with the clothes mover 20. This degree of engagement is defined by the cumulative loading/unloading of the clothes mover 20 by the fabric load and liquid.

Peak Amplitude can be determined from the waveform data. It can be calculated on a peak-by-peak basis or as a running average. The running average can be a cumulative running average, a moving window running average, or a weighted running average, for example. The running average can be calculated in a variety of ways, including, for example, multiple peak basis, stroke-by-stroke basis, or across multiple strokes. Thus, the timing of the calculation can be selected as desired. The amplitude can be calculated relative to any reference value, including the motor set speed. Other illustrative reference values are zero level, average plateau speed for example. It is currently contemplated that the Peak Amplitude will be calculated as a running average of the amplitudes of the peaks relative to a target clothes mover motor speed set point across multiple strokes.

Referring to FIG. 7 as an example, the target clothes mover motor speed value is 120 RPM. Each amplitude of the positive and negative peaks can be determined relative to the 120 RPM value. Some amplitudes will extend above the 120 RPM value and some will extend below the 120 RPM value. For the running average, each amplitude is expressed as an absolute value and the absolute values are summed for each of the forward and backward strokes. Preferably, a running average of the amplitudes during the forward and backward strokes is calculated and stored by the machine controller 32. The running average is then used as a determination of the degree of engagement, or the liquid level.

The machine controller 32 uses the determination of the degree of engagement to control the operation of the clothes washer. For example, during a fill step in a wash cycle, for example, the clothes mover 20 is rotated through a preselected number of preliminary oscillation cycles, for example five, while the clothes washer 10 is filled with liquid, or after an initial filling of the clothes washer 10. Thus, the clothes mover 20 will be rotated through five forward strokes and five backward strokes while the machine controller 32 keeps an average running total of the degree of contact. This can be accomplished by the machine controller receiving data samples of the motor speed from the sensor 31, trapping the peak values, determining an amplitude relative to the motor set speed, and maintaining an average running total of the amplitudes. While the number of preliminary oscillation cycles can be other than five, it has been shown that five cycles is sufficient to eliminate any variations inherent in the system.

At the end of the five cycles, the running average is compared to a preselected threshold value, which is empirically determined for different clothes washers, and is established based upon factors such as fabric type, laundry load size, laundering cycle, clothes mover configuration, motor type, transmission type, and the like. Thus, a matrix of threshold amplitude values will be developed for a particular clothes washer configuration, and these values will be stored in the machine controller 32. If the running average is greater than the threshold, then no more liquid need be added to the wash chamber. If liquid is currently being added to the wash chamber, then the addition of liquid is stopped. If the running average is less than the threshold, then more liquid needs to be added to the wash chamber. If liquid is currently being added to the wash chamber, it is continued. If liquid is not currently being added, then it is started.

This liquid level adjustment can be conducted at any time during the wash cycle. For example, it can be part of the filling step or it can be part of the wash or rinse steps. In this way, the fabric items are protected from unnecessary mechanical action from the clothes mover 20. Having the optimal level of liquid also facilitates an optimal chemical wash performance. This is so because having greater than the optimal volume of liquid reduces the chemical detergent concentration in the tub, whereas having less than the optimal volume of liquid reduces the circulation of the detergent through the clothes.

The predetermined threshold value of amplitude can represent an optimal liquid level reflecting an optimal combination of cleaning effort and fabric protection. An optimal liquid level has been reached when the amplitude running average reaches the preselected threshold value of amplitude.

The invention described herein provides an optimized laundering cycle by setting a liquid level sufficient for satisfactorily cleaning a laundry load, thereby reducing energy and water usage. At the same time, optimizing the liquid level minimizes the progressive wear to the laundry load caused by a less than optimal liquid level. Thus, the items being laundered have an enhanced lifespan, thereby saving the consumer costs related to replacement of such items. Finally, the utilization of motor speed or motor current in determining an optimal liquid level requires no additional instrumentation, thereby minimizing additional cost. The invention simply utilizes readily available information in a new manner to control an operation in order to optimize the laundering performance of a clothes washer.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A method for setting the liquid level in an automatic clothes washer comprising a wash tub defining a wash chamber for receiving fabric items and a clothes mover located within the wash chamber and driven by a motor to impart mechanical energy to the fabric items upon contact, the method comprising:

A) introducing liquid into the wash chamber;

B) moving the clothes mover relative to the wash chamber with the motor and outputting a waveform having ripples for one of the motor current and motor speed;

C) repeatedly determining a running average of the amplitude of the ripples for the waveform to define multiple running averages;

D) determining from the multiple running averages a degree of engagement between the clothes mover and the fabric items based on the multiple running averages; and E) repeating steps A-D until the degree of engagement is less than a predetermined threshold to thereby set the liquid level.

2. The method according to claim 1, wherein the degree of engagement is determined by comparing the multiple running averages to a reference value.

3. The method according to claim 2, wherein the comparison comprises determining a difference between the multiple running averages and the reference value.

4. The method according to claim 3, wherein the determining the difference between the multiple running averages and the reference value is conducted over at least one stroke of the clothes mover.

5. The method according to claim 4, wherein the difference between the multiple running averages and the reference value is averaged over a predetermined time and the average is compared to a threshold value.

6. The method according to claim 5, wherein the liquid level is set when the running average is equal to the threshold value.

7. The method according to claim 1, wherein the introduction of liquid comprises at least one of multiple discrete introductions of liquid or a continuous introduction of liquid.

8. The method according to claim 1, wherein the introduction of liquid comprises introducing liquid into at least one of the wash tub and wash basket.

9. The method according to claim 8, wherein the introduction of liquid comprises introducing liquid into an open face of the wash basket.

10. The method according to claim 1, wherein the moving of the clothes mover comprises moving the clothes mover through a predetermined stroke.

11. The method according to claim 10, wherein the moving of the clothes mover through a predetermined stroke comprises reciprocally moving the clothes mover.

12. The method according to claim 11, wherein the moving of the clothes mover comprises rotating the clothes mover.

* * * * *